US005516232A

United States Patent [19]

Filipski

[11] Patent Number: 5,516,232

[45] Date of Patent: May 14, 1996

[54] RUNOFF WATER DIVERTER

[76] Inventor: Roman F. Filipski, 2835 N. Damen Ave., Chicago, Ill. 60618

[21] Appl. No.: 245,440

[22] Filed: May 18, 1994

[51] Int. Cl.[6] ..... A01G 25/00

[52] U.S. Cl. ..... 405/36; 405/118; 137/236.1

[58] Field of Search ..... 137/236.1, 356, 137/875; 405/36, 39, 40, 52, 80, 118, 119, 120; 52/16

[56] References Cited

U.S. PATENT DOCUMENTS

| | | | |
|---|---|---|---|
| 925,053 | 6/1909 | Sturgis | 405/119 X |
| 2,500,452 | 3/1950 | Coffee | 405/118 |
| 2,979,082 | 4/1961 | Neves | 405/36 X |
| 3,599,711 | 8/1971 | Fowler | 137/875 X |
| 5,014,745 | 5/1991 | Watt | 52/16 X |
| 5,161,912 | 11/1992 | Schleuter et al. | 137/875 X |
| 5,322,387 | 6/1994 | Heine et al. | 405/36 |
| 5,358,006 | 10/1994 | Sweers | 52/16 X |

FOREIGN PATENT DOCUMENTS

| | | | |
|---|---|---|---|
| 2567551 | 1/1986 | France | 405/39 |
| 689569 | 4/1965 | Italy | 405/119 |
| 125112 | 6/1987 | Japan | 405/118 |
| 363782 | 2/1973 | U.S.S.R. | 405/40 |
| 647399 | 2/1979 | U.S.S.R. | 405/118 |
| 1147826 | 3/1985 | U.S.S.R. | 405/118 |
| 1667745 | 8/1991 | U.S.S.R. | 405/36 |

*Primary Examiner*—Terry Lee Melius
*Assistant Examiner*—John A. Ricci
*Attorney, Agent, or Firm*—Juettner Pyle Lloyd & Piontek

[57] ABSTRACT

A portable runoff water diverter can be placed in the path of a flow of runoff water to divert at least a portion of the water to a point where it can advantageously be used, for example to irrigate landscaping. The diverter defines at least one channel through which runoff water, that might otherwise flow to a sewer, is redirected. The diverter advantageously is made of a resilient material such as rubber, so that it may be used in an alley or along a curb, where a flow of runoff water occurs in response to rain, without being destroyed should it be run over by a vehicle.

12 Claims, 2 Drawing Sheets

RUNOFF WATER DIVERTER

BACKGROUND OF THE INVENTION

The present invention relates to devices for directing water, and in particular to a device for directing runoff water to a location where it may advantageously be used.

There is a need in residential areas to use water for irrigation purposes, for example to water lawns and other landscaping. However, with an increasing population, there have arisen conflicting competitive demands as to how water resources should be used. Where water resources are insufficient to fully supply both human and landscaping needs, the use of water for irrigation purposes normally is limited if not completely curtailed. On the other hand, if the water supply is sufficient to meet both human and landscaping needs, the costs for purifying the water so that it is fit for human consumption often result in the water being too expensive to be used for irrigation purposes.

Although water supplied by a municipality can be expensive, rainwater is free. However, unlike a municipal water supply, rainwater is neither available on demand nor necessarily in the quantity desired. When rain occurs, the rainwater irrigates the vegetation on which it falls, but the timing of the rain and the amount that falls cannot be controlled.

When it rains, much of it falls where it serves no useful purpose and simply flows away as runoff. For example, in a large metropolitan area such a city, a substantial amount of rain falls on streets and alleys, from which it flows into sewers. Although some falls on and irrigates vegetation, that which falls on streets and alleys is wasted from an irrigation standpoint.

OBJECTS OF THE INVENTION

An object of the present invention is to provide a portable runoff water diverter that can divert runoff water from its flowpath to a point where the water can advantageously be used.

Another object is to provide such a portable runoff water diverter that can divert runoff water flowing through an alley to a point where the water can be used for irrigation purposes.

A further object is to provide such a portable runoff water diverter that can direct water flowing along a street and adjacent a curb up and over the curb onto adjacent landscaping to irrigate the landscaping.

SUMMARY OF THE INVENTION

In accordance with the present invention, there is provided a portable runoff water diverter for being hand carried to and positioned in a flow of runoff water to divert at least a portion of the water flow to landscaping to be irrigated. The runoff water diverter comprises a body having a bottom wall and side wall means extending upwardly from the bottom wall. The bottom wall and the side wall means define a water inlet channel to the diverter and at least one water outlet channel from the diverter, and the diverter is positionable in a runoff water flow so that at least a portion of the runoff water enters the inlet channel and flows to, through and out of the outlet channel to landscaping to be irrigated.

In a contemplated embodiment, the diverter includes support means at a downstream end, which can elevate the downstream end so that the inlet channel slopes upwardly in the direction of flow of the water, whereby water flows upwardly through the inlet channel to, through and out of the at least one outlet channel. In addition, the at least one outlet channel may comprise two outlet channels, in which case the body includes means for diverting water flowing through the inlet channel into a selected one or the other of the outlet channels.

The foregoing and other objects, advantages and features of the invention will become apparent upon a consideration of the following detailed description, when taken in conjunction with the accompanying drawings.

DETAILED DESCRIPTION

Figure 1:
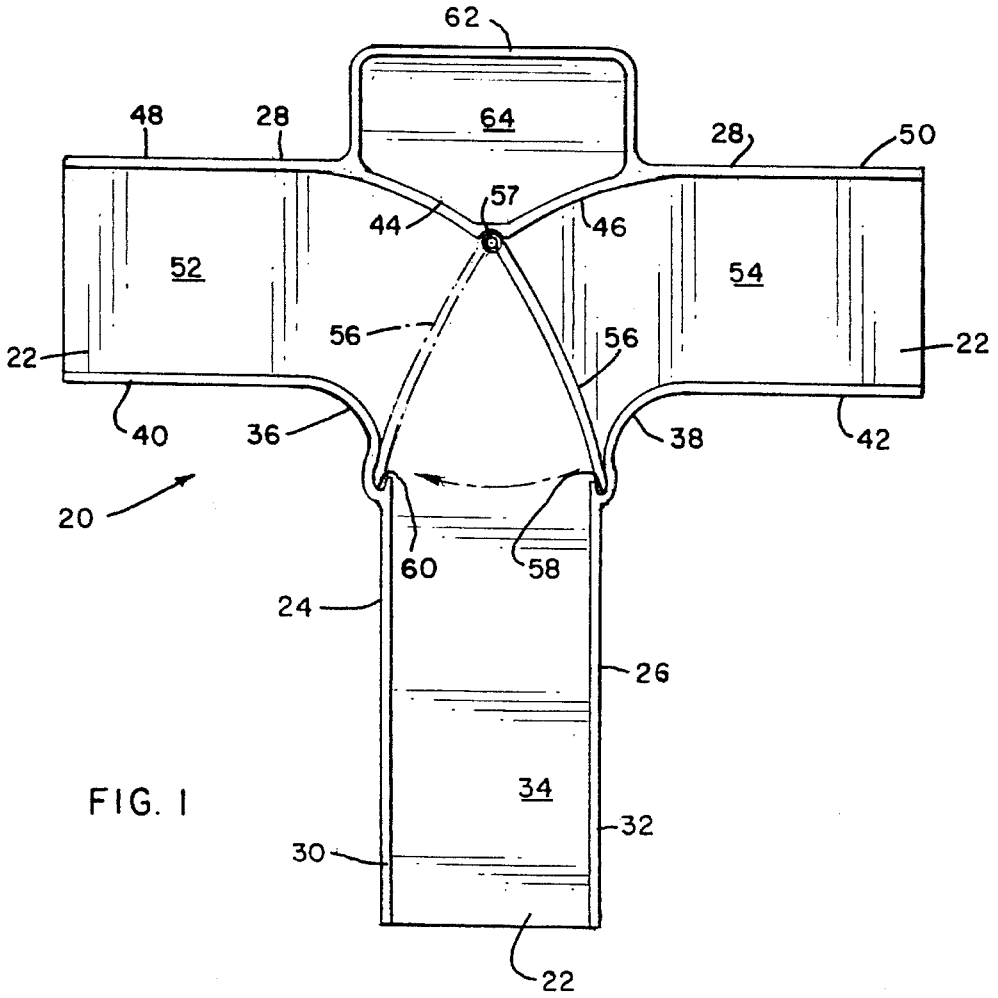
FIG. 1 is a top plan view of a runoff water diverter configured according to the teachings of the present invention.
Figure 2:
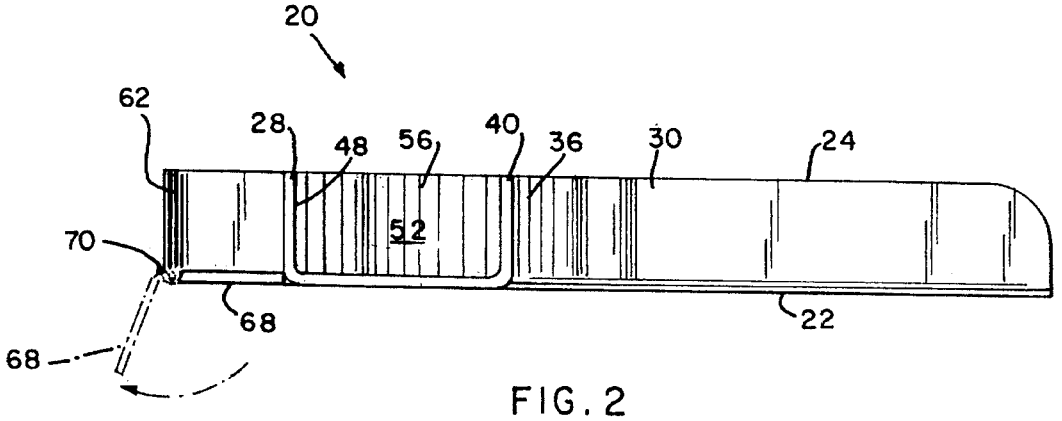
FIG. 2 is a side elevation view of the runoff water diverter.

A runoff water diverter configured according to the teachings of the invention is shown in the drawings and indicated generally at 20. With reference to FIGS. 1 and 2, the diverter 20 advantageously is integrally formed of a molded resilient material such as rubber, and includes a bottom wall 22 and side walls 24, 26 and 28 extending upwardly from the bottom wall. The side walls 24 and 26 have respective straight sections 30 and 32 that extend in parallel, spaced relationship and define, with the bottom wall 22, a water inlet channel 34 to the diverter. The sidewalls 24 and 26 also have respective curved sections 36 and 38 and respective second straight sections 40 and 42 that extend outwardly away from each other. The side wall 28 has two curved sections 44 and 46 that are joined generally along a centerline of the inlet channel 34 and from there they curve outwardly to join respective straight sections 48 and 50 that extend away from each other and generally lie in a common plane. The straight sections 48 and 50 also extend generally parallel to and spaced from respective ones of the straight wall sections 40 and 42. Together with the bottom wall 22, the straight wall sections 40 and 48 define a first water outlet channel 52 from the diverter and the straight wall sections 42 and 50 define a second water outlet channel 54 from the diverter.

The diverter 20 and its bottom wall 22 are generally cruciform shaped. The arrangement is such that runoff water entering an upstream end of the inlet channel 34 flows through the inlet channel for exit from the diverter through the outlet channels 52 and 54. Normally, it is desirable to be able to direct the outflow of water in a single direction, i.e., either through the first outlet channel 52 or the second outlet channel 54. To enable the water flow to be selectively directed through either the outlet channel 52 or 54, a movable gate means or door 56 is provided. One vertical edge of the door is pivotally hinged to the juncture between the curved wall sections 44 and 46, for example by being attached thereto by a thin web 57 of material. The hinge enables the door to swing between a first position shown in solid lines in FIG. 1, where the door closes the outlet channel 54 and directs runoff water flowing from the downstream end of the inlet channel 34 into the upstream end of the outlet channel 52, and a second position shown in phantom lines, where the door closes the outlet channel 52 and directs water flowing from the inlet channel into the outlet channel 54. To hold the door in position, latches 58 and 60 are in the respective side walls 26 and 24, into which latches the free edge of the door, opposite from the hinge 57, is insertable to hold the door in one position or the other.

The diverter 20 is adapted to be placed in the path of runoff water to divert at least a portion of the water. To prevent the diverter from being moved out of place by the force of the water, a U-shaped wall 62 extends upwardly from the bottom wall 22 and connects at its ends to junctures between the curved wall sections 44 and 46 and the straight wall sections 48 and 50, to define a compartment 64 in which a weight 66 (FIG. 3) may be placed to hold the diverter in place against the force of flowing water.

The diverter 20 can redirect water flowing along a street up and over a curb, if the flow of water is sufficiently fast to enable the water to flow upwardly to at least the height of the curb. When used in such manner, the downstream end of the diverter is supported in elevated position. For the purpose, a support 68 connects to a lower end of the upright wall 62 by means of a hinge 70 that may comprise a thin web of material. The support 68 is adapted to be pivoted between a position where the diverter 20 lies generally fiat, as shown in solid lines in FIG. 2, and a position supporting a downstream end of the diverter in elevated position, as shown in phantom lines in FIG. 2 and in solid lines in FIG. 4.

Figure 3:
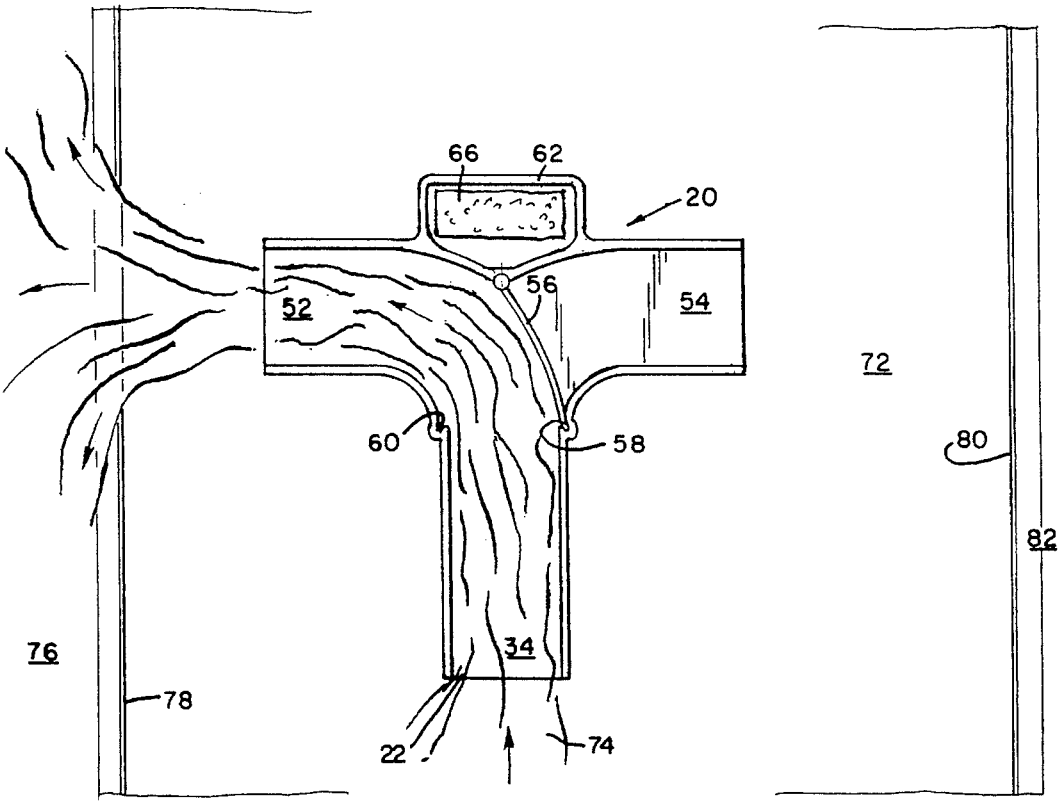
FIG. 3 is a top plan view of the runoff water diverter, showing it in use diverting runoff water flowing through an alley to a point of use.

FIG. 3 shows the diverter 20 directing runoff water, flowing through an alley 72, from a course it otherwise would follow to a point where it may advantageously be used. For example, the diverter can direct the runoff water, which otherwise would flow into a sewer, to a residential backyard 76 in order to water grass or other landscaping. The diverter is relatively light and hand portable, and with it placed in the center of the alley, and with the door 56 latched in position to establish a path from the inlet channel 34 to the outlet channel 52, the diverter directs runoff water from the alley onto property for use in watering landscaping. Although for the purpose of illustrating the invention the outlet channel 52 is shown as terminating prior to a property line 78, it is understood that a separate channel could be provided, if necessary, to guide diverted runoff water from the outlet channel 52 onto the property. It is understood, of course, that for proper operation of the diverter, the flow rate of the runoff water 74 must be sufficiently fast that the kinetic energy of the water enables the diverted water to flow onto the property 76, and that in use of the diverter, only a portion of the runoff water would normally be diverted. Also, while the door 56 is shown in position to direct diverted runoff water through the outlet channel 52, it could be moved to its other position and extended into the latch 60, so that the diverter would then direct runoff water through the outlet channel 54 and across an opposite property line 80 onto property 82.

Figure 4:
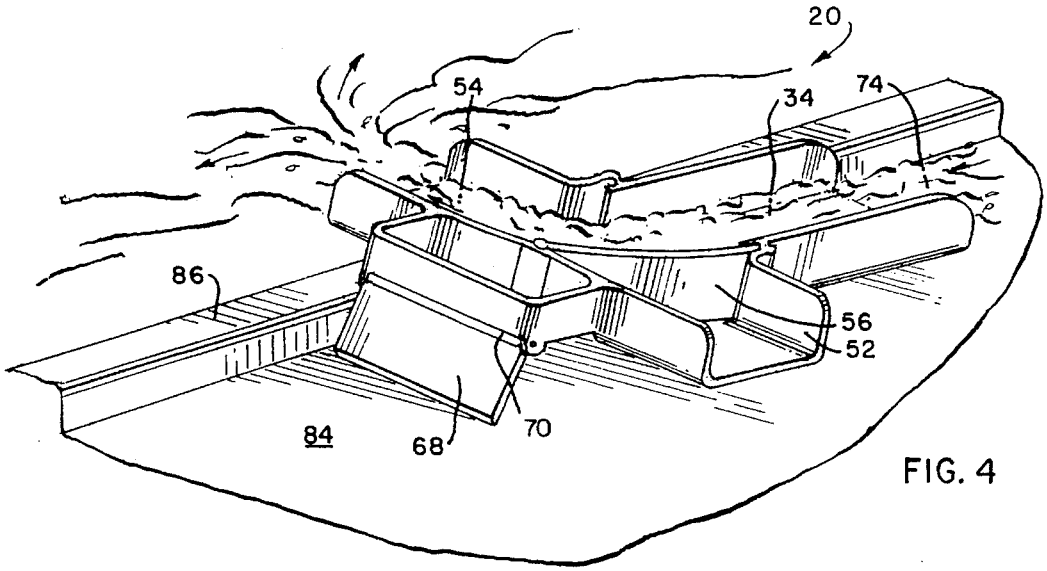
FIG. 4 is a perspective view of the runoff water diverter, showing it in use diverting runoff water flowing through a street up and over an adjacent curb to a point of use.

FIG. 4 shows the diverter 20 in use directing runoff water 74, flowing along a street 84, up and over an adjacent curb 86. The diverter is in the street alongside the curb, and the support 68 is pivoted downwardly to elevate the downstream end of the diverter so that the outlet channel 54 extends over the curb. Here, the door 56 is in the latch 60 so that runoff water entering the inlet channel 34 will flow through the outlet channel 54 and over the curb onto property to be irrigated. It is understood that the velocity flow of the runoff water entering the diverter must be sufficient that the kinetic energy of the water will carry the water upwardly to and over the curb and out of the outlet channel 54. In other words, the kinetic energy of the runoff water as it enters the inlet channel 34 must at least be equal to the increase in potential energy of the water as it is elevated.

The invention provides a runoff water diverter that is particularly adapted for use in diverting runoff rainwater onto property to be irrigated, for example onto grass or other landscaping. The diverter advantageously enables runoff rainwater, which otherwise would flow to a sewer and be wasted, to economically be used to irrigate landscaping. Naturally, rain falling directly on such landscaping will also irrigate the landscaping, but often the quantity of direct rainfall is not sufficient for the purpose, in which case the diverter helps to make up the deficiency.

While one embodiment of the invention has been described in detail, various modifications and other embodiments thereof may be devised by one skilled in the art without departing from the spirit and scope of the invention, as defined in the appended claims.

What is claimed is:

1. A portable runoff water diverter for being hand carried to and positioned in a flow of runoff water to divert at least a portion of the water flow to and landscaping to be irrigated, said runoff water diverter comprising a body having a bottom wall and side wall means extending upwardly from said bottom wall to an open top of said body, said bottom wall and said side wall means defining a water inlet channel to said diverter and at least one water outlet channel from said diverter in communication with said inlet channel, said diverter being positionable in a runoff water flow so that at least a portion of the runoff water enters said inlet channel and flows therethrough to, through and out of said outlet channel to landscaping to be irrigated, wherein said at least one water outlet channel comprises first and second water outlet channels each having an upstream end and a downstream end, and including means for selectively placing said downstream end of said inlet channel into communication with the upstream end of either said first or said second outlet channel, whereby runoff water flowing into said upstream end of said inlet channel can be selectively directed into, through and out of either said first or said second outlet channel, wherein said means for selectively placing comprises gate means movable between first and second positions, said gate means in said first position establishing communication between said downstream end of said inlet channel and said upstream end of said first outlet channel and blocking communication between said downstream end of said inlet channel and said upstream end of said second outlet channel, said gate means in said second position establishing communication between said downstream end of said inlet channel and said upstream end of said second outlet channel and blocking communication between said downstream end of said inlet channel and said upstream end of said first outlet channel, wherein said body includes support means at a downstream end of said bottom wall for supporting said bottom wall downstream end in an elevated position, so that said inlet channel slopes upwardly from said upstream end to said downstream end thereof, and so that said downstream ends of said first and second outlet channels are vertically elevated with respect to said upstream end of said inlet channel, whereby said diverter directs runoff water to flow upwardly to an elevated delivery point.

2. A runoff water diverter as in claim 1, including hinge means connecting said support means to said body at said bottom wall downstream end for movement of said support means between a first position where said support means holds said bottom wall downstream end in an elevated position, and a second position where said support means does not hold said bottom wall downstream end in an elevated position.

3. A runoff water diverter as in claim 2, wherein said diverter is integrally formed of a resilient material.

4. A runoff water diverter as in claim 1, said body including compartment means formed by said bottom wall and said side wall means, into which a weight can be placed to hold said diverter against movement by the force of diverted runoff water.

5. A runoff water diverter as in claim 1, wherein said diverter is generally cruciform in shape.

6. A runoff water diverter as in claim 5, wherein said outlet channels extend in generally opposite directions from each other and generally perpendicular to said inlet channel.

7. A portable runoff water diverter for being hand carried to and positioned in a flow of runoff water to divert at least a portion of the water flow to landscaping to be irrigated, said runoff water diverter comprising a body having a bottom wall and side wall means extending upwardly from said bottom wall, said bottom wall and said side wall means defining a water inlet channel to said diverter and at least one water outlet channel from said diverter in communication with said inlet channel, said diverter being positionable in a runoff water flow so that at least a portion of the runoff water enters said inlet channel and flows therethrough to, through and out of said outlet channel to landscaping to be irrigated, and including movable support means at a downstream end of said body for selectively elevating said downstream end so that said bottom wall is sloped upwardly in the direction of water flow through said inlet channel, whereby water flowing into said inlet channel flows upwardly through said inlet channel to, through and out of said at least one outlet channel.

8. A portable runoff water diverter for being hand carried to and positioned in a flow of runoff water to divert at least a portion of the water flow to landscaping to be irrigated, said runoff water diverter comprising a body having a bottom wall and side wall means extending upwardly from said bottom wall, said bottom wall and said side wall means defining a water inlet channel to said diverter and at least one water outlet channel from said diverter in communication with said inlet channel, said diverter being positionable in a runoff water flow so that at least a portion of the runoff water enters said inlet channel and flows therethrough to, through and out of said outlet channel to landscaping to be irrigated, wherein said diverter bottom wall is generally cruciform in shape and said at least one water outlet channel comprises two water outlet channels that each communicate with and extend in generally opposite directions from a downstream end of said water inlet channel.

9. A runoff water diverter as in claim 8, wherein each of said two outlet channels extends generally perpendicular to said inlet channel.

10. A runoff water diverter as in claim 8, including means for selectively directing a flow of water from said inlet channel into one or the other of said outlet channels.

11. A portable runoff water diverter for being hand carried to and positioned in a flow of runoff water to divert at least a portion of the water flow to landscaping to be irrigated, said runoff water diverter comprising a body having a bottom wall and side wall means extending upwardly from said bottom wall, said bottom wall and said side wall means defining a water inlet channel to said diverter and at least one water outlet channel from said diverter in communication with said inlet channel, said diverter being positionable in a runoff water flow so that at least a portion of the runoff water enters said inlet channel and flows therethrough to, through and out of said outlet channel to landscaping to be irrigated, wherein said at least one water outlet channel comprises first and second water outlet channels each having an upstream end and a downstream end, said inlet channel has an upstream end and a downstream end, and including means for selectively placing said downstream end of said inlet channel into communication with the upstream end of either said first or said second outlet channel, whereby runoff water flowing into said upstream end of said inlet channel can be selectively directed into, through and out of either said first or said second outlet channel, wherein said means for selectively placing comprises gate means movable between first and second positions, said gate means in said first position establishing communication between said downstream end of said inlet channel and said upstream end of said first outlet channel and blocking communication between said downstream end of said inlet channel and said upstream end of said second outlet channel, said gate means in said second position establishing communication between said downstream end of said inlet channel and said upstream end of said second outlet channel and blocking communication between said downstream end of said inlet channel and said upstream end of said first outlet channel, wherein said gate means comprises a door, hinge means connecting said door to said side wall means for movement between said first and second positions, and latch means for releasably holding said door in either said first or said second position.

12. A runoff water diverter as in claim 11, wherein said runoff water diverter is integrally formed of a resilient material.

* * * * *